US008661604B2

(12) United States Patent
Vila Fernandez

(10) Patent No.: US 8,661,604 B2
(45) Date of Patent: Mar. 4, 2014

(54) MOP AND CONTAINER SYSTEM FOR THE DRAINAGE OF LIQUIDS

(75) Inventor: Ricardo Jose Vila Fernandez, Montevideo (UY)

(73) Assignees: Ricardo Jose Vila Fernandez, Montevido (UY); Marcela Della Frera, Santiago (CL)

( * ) Notice: Subject to any disclaimer, the term of this patent is extended or adjusted under 35 U.S.C. 154(b) by 6 days.

(21) Appl. No.: 13/445,321

(22) Filed: Apr. 12, 2012

(65) Prior Publication Data

US 2013/0269130 A1 Oct. 17, 2013

(51) Int. Cl.
*A47L 13/58* (2006.01)

(52) U.S. Cl.
USPC ..... 15/260

(58) Field of Classification Search
USPC ..... 15/260
See application file for complete search history.

(56) References Cited

U.S. PATENT DOCUMENTS 3,614,802 A * 10/1971 Seufert ..... 15/170
8,015,652 B2 * 9/2011 Chiang ..... 15/119.1
8,239,997 B2 * 8/2012 Lin ..... 15/260

* cited by examiner

*Primary Examiner* — Randall Chin
(74) *Attorney, Agent, or Firm* — Defillo & Associates, Inc.; Evelyn A Defillo

(57) ABSTRACT

A mechanical cleaning system mop and container for liquid draining including a container having a multifunction handle-lever-pedal element coupled to the container, and a mop especially designed to be used with the container. The mop allows the cleaning of floors, leaving them almost dry. The drainage of the mop is performed by pressing the mop over a back support table for supporting mops of the container and pressing the multifunction handle-lever-pedal element.

7 Claims, 4 Drawing Sheets

MOP AND CONTAINER SYSTEM FOR THE DRAINAGE OF LIQUIDS

FIELD OF INVENTION

The present invention relates to a mechanical cleaning system having a mop and container for draining liquids where the mop is designed to be used in cleaning and drying floors and other surfaces, especially in households, without being restricted to, and wherein the drainage container is designed to hold liquids and solid particles remaining in the mop after the cleaning and drying, which are drained by compression according to the present invention.

PROBLEM TO BE SOLVED

During the use of a mop for cleaning and drying floors, in homes and other places, as well as during the liquid drainage operation from the mop and their deposit in a holding container, it is especially desired that the above mentioned operations occur with the least discomfort, that the cleaning operation, floor drying, etc., are carried out with the greatest efficiency and speed, and that the liquid extraction from the mop is carried out with the least effort. At present times it is desired that the cleaning activities, especially in the house, be simple, comfortable and efficient, not only in what it has to do with the actual activity of cleaning the house but also with the cleaning activity of the utensils designed for such purposes.

The cleaning and drying of floors, surfaces, etc., are tasks that demand passing through and going over the surfaces with cloths or mops until achieving the desired cleaning and drying. To provide efficiency to the cloth or mop, various materials have been disclosed for their fabrication, including complex structures and designs. These known solutions do not provide comfort to the user, may complicate the operation of the device, and do not allow speeding up the process.

Currently, many of the known mops are heavy and/or complex, given the type of mechanism for twisting or squeezing. In other cases, it is uncomfortable having to twist the cloth or mop for several reasons, namely: the amount of force necessary to be effective, the danger of hurting the hands with some cutting element that has been picked up by the cloth or mop, or the fact of having to use protective gloves to protect the hands from dirt.

The containers used as recipients to hold the liquids held in the cloths and mops are currently being incorporated to more or less complex mechanisms that allow performing or completing the task of twisting or squeezing. The mentioned twisting or squeezing mechanisms produce instability to the holding container, which may overturn, dumping the liquids on the already clean and dry surfaces. On other occasions, it has been disclosed that containers having complex drainage mechanisms for cloth or mop, which often require the user to bend and/or make a major physical effort, the recipients are heavy, complicated in its manufacture, transport and storage, their cleaning takes time and extra work, and the need for having spare parts for a multiplicity of pieces, reducing many times its durability.

DESCRIPTION OF PRIOR ART

In analyzing the prior art, it is possible to find mop drainage containers that do not provide the use of any mechanical lever between the pedal and the pressing mechanism of the mop. Indeed, it is necessary to have a small path with great force on the mop to obtain an efficient pressure to achieve a perfect drainage of liquid, which is particularly necessary in case of the mops that are more dense.

In the drainage devices known by the inventor, the path of the pedal is equal to the path of the pressing mechanism of the mop or drainage element, there is not a lever that will benefit in any way by the exerted force, but the same applied force is transmitted demanding the user to provide a greater effort to have a suitable moderate result without great efficiency. This gets worse in the solutions known by the inventor, because there is a noticeable loss of strength in the transmission mechanism by the friction and torsion, the amount of loss which is extremely important in the final result. The consequence is an insufficient mechanism to the intended effects given, since they do not even transmit the force of the user to the mop.

In addition, it is observed in many cases very complex formats and a lot of parts to form them, which results in the total absence of practicality, as it relates to the cleaning and maintenance of the devices.

To this, in many cases, is added the excessive size necessary for the container to use a conventional sized mop. After analyzing several solutions found in the global market, the present inventor notes that in some cases, the length of the containers is more than twice its main width. The main width of the container should be greater than the width of the mop. A known mop is approximately 20 to 30 cm wide so, taking into account a minimum length of 20 cm, if the container is two and a half times, the length would be about 60 cm. If we add to this the minimum length of the pedal so that the container works correctly, the pedal shall not be less than 15 cm, so adding this length to the length of the container we have a total length of 75 cm as a minimum measurement so that the container works correctly. The width should exceed the width of the mop, so the width should be from 28 to 30 cm; adding the wall of the container and the space of the mechanisms that transmit the energy to the pedal, we would have to add not less than 5 cm, then we would be in at least 35 cm. The height of a fringe or cloth mop is not less than 25 cm when hung for its drainage, so that the device where the mop settles for its pressing to achieve the drainage should not be less than this measurement so that it can operate with a suitable mechanism. Said device is positioned on the container so that the device's height should be added to the container's height, that is not less than approximately 25 cm, thus the container can contain an acceptable liquid level to submerge the mop when rinsing, or not spilling the liquid while moving the container. Following a logical and practical approach, storing and manipulating this kind of container is uncomfortable and inconvenient given the measurements of 75 cm in length×35 to 45 cm in width×50 cm in height approximately.

With regard to its weight during use, in many well-known containers the weight is also excessive. Following the above-identified measurements, the container would contain an internal space, which should have as a minimum to operate, 60 cm in length×20 cm in width (for the mop) and 15 cm in height for an acceptable liquid level. The approximate amount of liquid that must be loaded to have an acceptable level in which a mop can be submerged is approximately 18 liters, taking into account that the level of a common bucket is approximately 5 liters. As a result, a lot of liquid is required, increasing excessively the weight of the container, which also adds to its own weight caused by the complex mechanism, which would finally end in a container of no less than 20 kilos to maneuver, which lacks practicality for any person.

In addition, the analyzed devices present the problem of the excessive consumption of liquid needed to make them work in a time that seeks to reduce the use of natural resources and in a time in which it is beneficial saving water, since using containers as described involves using 4 times more water than used by any common bucket. Regarding the excessive amount of liquid, emptying the containers lacks practicality because the container cannot be lifted as a normal bucket because of its excessive weight. Then emptying the container must be done from a drainage tap which represents a discomfort in having to find a suitable site, and if the suitable site cannot be found, the emptying step must be done by using small containers with several trips to the drainage place.

There are cases in which the devices are equipped with wheels or other elements to supposedly facilitate their transport. Said devices are not efficient on all types of surfaces, for example, if the devices have wheels, in case of a ladder or other impediment to avoid, it becomes very difficult for its complexity and excessive weight and also these devices cannot be lifted and carried as they are extremely unstable. Indeed, in the analyzed devices, the container could fall with the liquid since the buckets are not connected to the pressing mechanism because they are portable, and by the mere fact of its size and weight make it practically impossible to maintain stability. This is also aggravated by not having logical and practical means to grab the containers jointly with the pressing and drainage devices for transportation purposes, since it is necessary to independently transport them.

SUMMARY OF THE INVENTION

An objective of the invention is to provide a mechanical cleaning system that during the use of a cleaning mop and floor drying, etc., in homes and other places, as well as during the liquid extraction operation from the mop, allows to perform the above mentioned operations with greater comfort, more efficiency and speed as well as hygienically and with no risk of injury to the user, and that the liquid extraction from the mop is carried out with the least effort. The present invention provides the maximum possible simplicity for the purpose of minimizing the number of pieces and weight, making it easy to manufacture and use.

The system comprises a container with a multifunction element handle-lever-pedal, and a mop. The container is a recipient designed not only to contain water and detergent and to be a dirty water deposit, but to integrate the liquid extraction system of the mop. The multifunction element handle-lever-pedal which forms part of the container is a one-piece device with sections having diverse functions. The pedal section is designed to receive the force exerted by the user. Said force is transmitted by the lever section to extensions belonging to the multifunction element, said extensions being located in the lever section. The extensions end in hooks to press the mop inside the container and to allow extracting liquids and solid particles from the mop. Then, the drainage is done by mechanical pressing in a practical, comfortable, simple, and efficient way. The manufacture cost of the container with the multifunction element handle-lever-pedal is low, since a single matrix is sufficient.

It is another objective of the present invention to better use the force exerted by the pressure from the pedal section of the multifunction element handle-level-pedal, since the path of the pedal section is 5 to 6 times greater than the path of the hooks used to press the mop achieving an excellent conversion to a path 5 to 6 times smaller, but with an increase of 5 to 6 times the force exerted on the pedal section. Between the pedal section and the hooks that exert the force, it has absolutely removed all kinds of mechanisms because they lead to a loss of energy and complex maintenance, increase in volume, and manufacturing costs. A one single multifunction element handle-lever-pedal is therefore designed to do all the tasks, making more efficient the use of the pressure exerted on the pedal section, thus achieving a very lightweight pedal section with a tremendous pressure on the mop, that provides a draining power that exceeds the necessary in absolutely all of the cases. The purpose is to have a long path of the pedal section and shortening of the compression path of the mop, increasing proportionally to the force.

It is also an objective of the present invention to make it easy to drain, clean, and store the device.

The container comprises a recipient having a rectangular shaped base and slightly larger at the top end. In the internal rear part of the recipient, forming part of the same, there is a back support table for supporting the mop. The back support is a section of the rear internal wall of the recipient that runs from the upper edge of the rear wall to an appropriate depth in which is defined the back support table for supporting mops that extend toward the center of the container covering a quarter of the same. Under the back support table for supporting mop two orifices, one in each one of the sides of the recipient, serve for the coupling with the multifunction element handle-lever-pedal. Upwards and near the orifices, two hollows have been designed, one in each one of the sides of the recipient, that are used to connect the hooks of the multifunction element handle-lever-pedal. Both hollows are located above the back support table for supporting mops. On the front wall of the container a central depression serves to facilitate the task of pressing the pedal section of the multifunction element handle-lever-pedal. In the upper edge of the same wall on both sides of the central depression there are two anti-splash flanges that serve to ensure that the user of the system can perform the tasks in a hygienic way. The size (volume) and weight of the container with a multifunction element handle-lever-pedal are equal to the one for a conventional bucket. The back support table supports mops and the multifunction element handle-lever-pedal with its hooks provides the pressing for the draining of the mop, dropping the draining liquids inside the container.

The multifunction element handle-lever-pedal is a one piece device having a U-shape that matches the shape of the container in the horizontal direction. The handle-lever-pedal includes in the internal ends of the arms of the U, two small cylinders (hereafter referred to as insertion cylinders), one on each arm. Each one of the insertion cylinders are inserted and wrapped in one spring in the side hollows of the container to attach the handle-level-pedal to the same. In each of the arms of the U, includes an extension having the shape of a prism parallelogram of small thickness that ends in its upper end with a hook oriented towards the interior of the U. These extensions are located in the lever section as described below. The hooks are coupled in the lateral openings of the container towards the inside of the same to press the mop. The curve of the U is the pedal section located at the front side of the container, the central depression on the front wall of the container facilitates the pressure on the pedal section, for example, with the foot. The arm of the U is the lever section because it describes an upward-downward movement during the pressure and the release of the pedal section. The lever section transmits a force to the extensions on the multifunction element and the extensions to the hooks that press the mop on the back support table for supporting mops. The entire U comprises, in turn, the handle of the container. In the insertion cylinder section there are small cylinders that are wrapped in springs that connect the handle-lever-pedal to the container.

The mop of the present invention comprises a body made of a spongy (porous) and highly absorbent material attached to the underside of a base of rigid material with a rectangular prism shape having an extension at its external top end. The spongy body has the same shape as the base. In the extension of the external superior part of the base a handle is connected, for example, by means of thread, which allows the manipulation of the mop. Into the body of the spongy and highly absorbent material, placed in the longitudinal way, there is a sheet or plate made of flexible material with some stiffness, which has the same length and less thickness of the spongy body, which is perpendicularly attached to the base of the mop. The sheet has a height slightly smaller than the height of the body of spongy and highly absorbent material. The base of the mop has the same shape as the back support table for supporting mops of the container; thus, its form is appropriate for the pressing, leaving the sides of the mop against the internal side faces of the recipient at the place where the hooks of the extensions on the handle-lever-pedal are slid for making contact with the base of the mop.

The mop is introduced into water and detergent previously loaded in the container, then scrubbing the mop on the floor with a soft pressure so that the spongy body of the mop slightly rubs the floor to soften any dirt, then the mop is pressed into the container draining liquids and then is passed again over the floor pressing this time more forcefully; thus, the sheet sandwiched in the spongy body is exposed to contact the floor and sweep the liquid gathering in front of the same and allowing the spongy body to absorb the liquid and to collect the solid particles more easily, leaving the floor section located behind the sheet without any liquid and almost dry. The mop is again set on the back support table for supporting mop and the pedal section of the handle-lever-pedal is pressed, pressing the mop to drain the liquids that fall by gravity into the container as well as the first time. Then the mop is drained by pressing inside the container draining the liquids and leaving the mop ready to work again. The handle-lever-pedal is the transportation means and the energy exerted in the handle-lever-pedal is used as a pedal towards the hooks located in the lever section to compress the mop over the back support table for supporting mops. To drain the mop, the mop is placed over the back support table for supporting the mops. Then, the pedal section of the handle-lever-pedal is pressed so the hooks located at the ends of the extensions located in the lever section of the U come into contact with the base of the mop pressing the same. The exerted force on the pedal section and transmitted by the lever section of the handle-lever-pedal is multiplied in the pressing. The pressure applied in the pedal section is very soft and it is not necessary to bend down in view of the handle-lever-pedal. The springs that wrap the insertion cylinders exert an upward force to the handle-lever-pedal so that it can return to its resting position once the pressure in the pedal section is withdrawn. The insertion cylinders act as an axis for the handle-lever-pedal to move from the top to the bottom over the sides of the container, so the handle-lever-pedal has its axis base connected to the mentioned container.

DETAILED DESCRIPTION OF THE BEST EMBODIMENT OF THE INVENTION

The liquid drainage container according to the invention may be manufactured in plastic material, and the mop part for the cleaning and drying, etc. of floors, surfaces, etc., may be of a spongy and highly absorbent material and the sheet or plate may be made, for example, of plastic flexible material with some rigidity.

Figure 1:
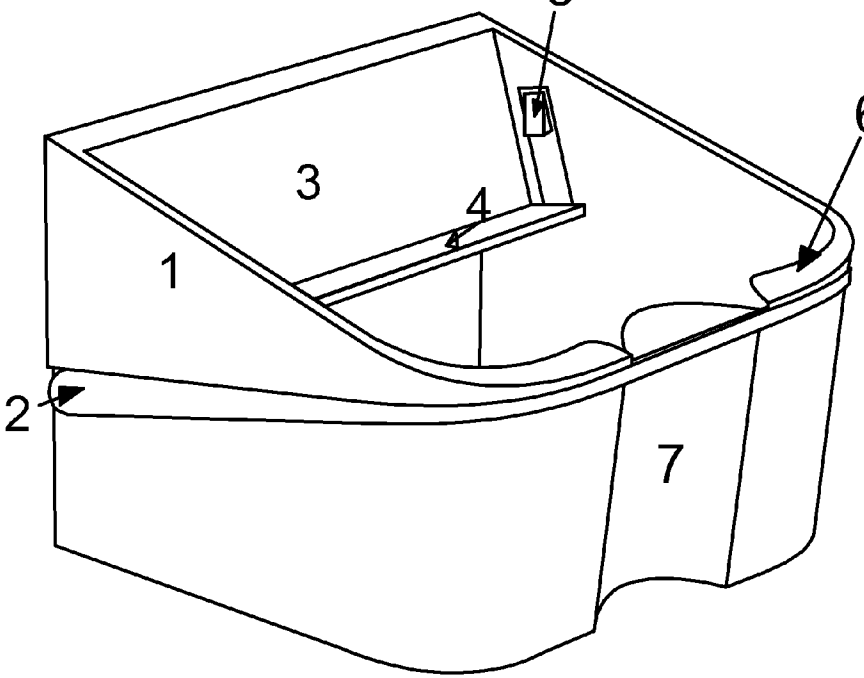
FIG. 1 shows a perspective view of a preferred design of the container (1) including the multifunction handle-lever-pedal element (2) according to the invention.
Figure 3:
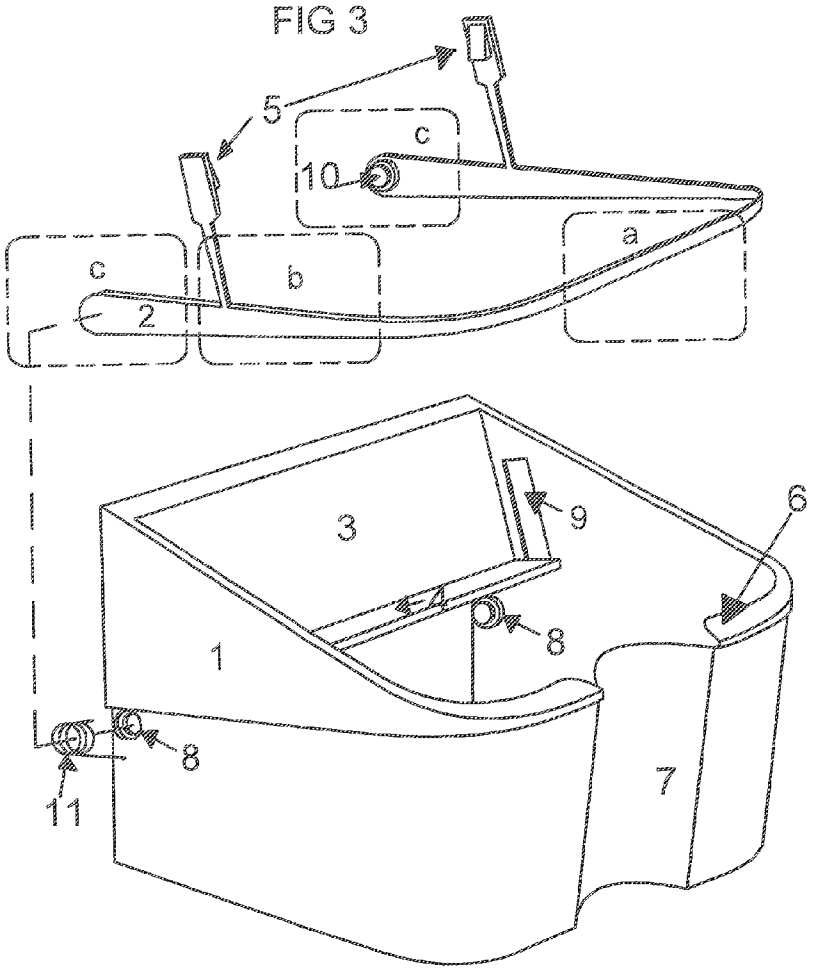
FIG. 3 shows a perspective view of the movement of the container (1) including a multifunction handle-lever-pedal element (2) having a pedal section (a), a lever section (b), insertion cylinders section (c) according to the invention.

In reference to FIGS. 1 and 3, in a manufacturing example, the liquid extractor container (1) may be a single piece of lightweight material preferably plastic. The container (1) has a cavity to contain liquids; a flange (6) on the front section to prevent splash during use; a depression (7) may be placed in the front section of the container to provide room for the foot of the user so that the user may comfortably push the multifunction handle-lever-pedal element (2) in the pedal section (a) and transmit force through the lever section (b); a back support table for supporting mop (3,4) on which to rest the mop for its pressing; two hollows (8), one in each of the outer sidewalls of the container are located under the back support table for supporting mops, the hollows (8) are designed for the coupling of the insertion cylinders (10) located in the insertion cylinder section (c) of the multifunction handle-lever-pedal element (2) and the springs (11); two hollows (9), one in each one of the internal side faces of the container located on the table support for supporting objects, they are designed for the movement of the hooks (5) that compress the mop. The multifunction handle-lever-pedal element (2) with a U-shape has two extensions in the lever section with a rectangular shape whose upper ends finish in hooks (5) oriented inward to be coupled in the side hollows of the container (9).

Figure 2:
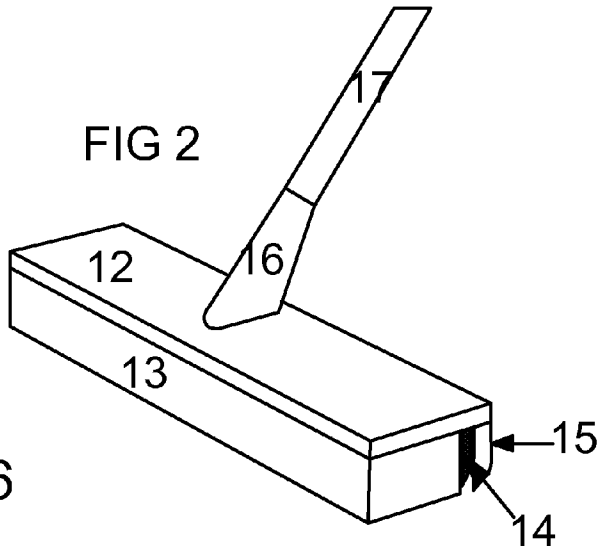
FIG. 2 shows a perspective view of the mop according to the invention.
Figure 4:
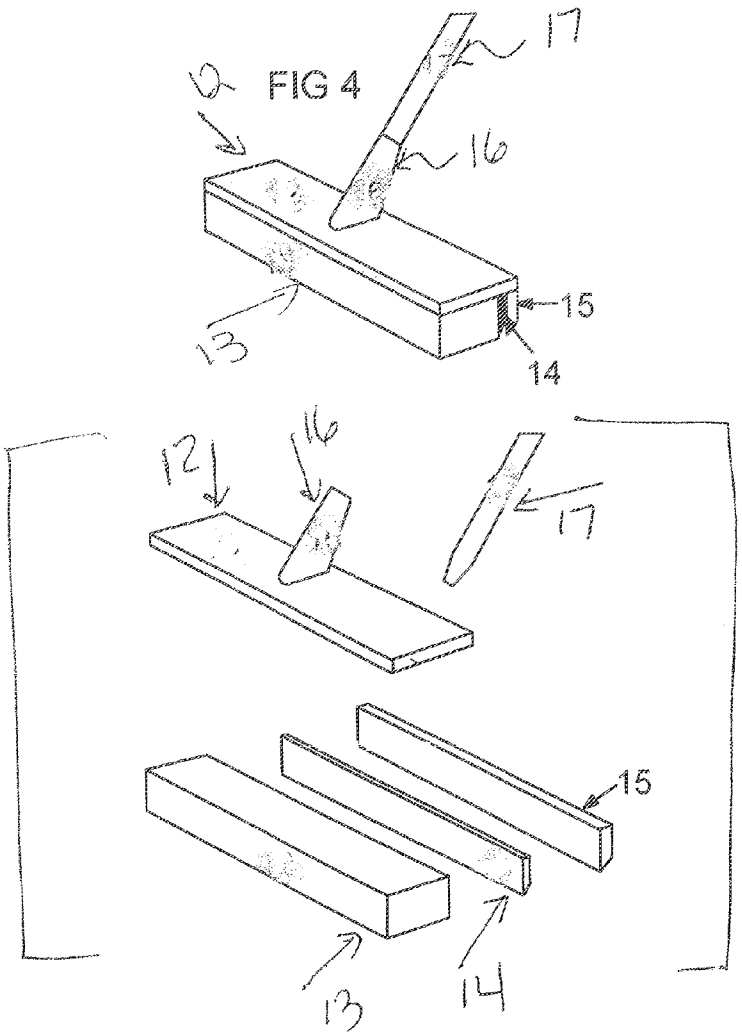
FIG. 4 shows an exploited view of the mop according to the invention.

In reference to the FIGS. 2 and 4, in a manufacturing example, the mop has a base (12) with extension (16) in the external upper end wherein a handle (17) is coupled by thread, a spongy and highly absorbent body (13, 15) is attached to the base (12), a sheet or plate (14) of rubber or silicone or other flexible element with some rigidity is intercalated longitudinally oriented attached to the base (12).

Figure 5:
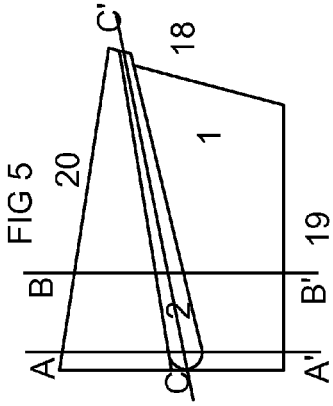
FIG. 5 shows a side view of the A, B and C cuts made in the container (1) with the multifunction handle-lever-pedal element (2).

In relation to FIG. 5, the bottom end (19) and the upper end (20) of the liquid drainage container (1) are shown.

Figure 6:
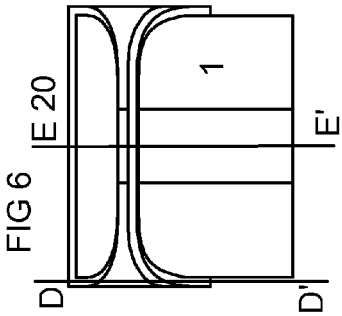
FIG. 6 shows a front view of the D and E cuts made in the container (1) with the multifunction handle-lever-pedal element (2).

In relation to FIG. 6, the upper end (20) of the liquid drainage container (1) is shown.

Figure 7:
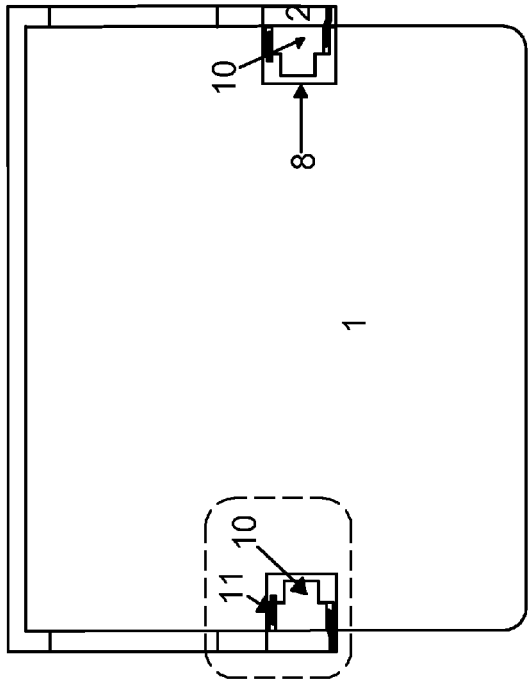
FIG. 7 shows a front view of the container (1) with the multifunction handle-lever-pedal element (2) where a cross-section A-A' has been made according to that described in FIG. 5, showing the details of the insertion cylinders (10), which are the coupling mechanism of the base axis of the multifunction handle-lever-pedal element in the hollows (8) of the container and the details of the spring (11) that supports the weight of the handle-lever-pedal.

In reference to FIG. 7, it shows a top view of the container showing the fitting in mechanism of the multifunction handle-lever-pedal element wherein the insertion cylinders (10) are coupled to the hollows (8) from the external side walls of the liquid drainage container (1). FIG. 7 also shows the details of the fitting in the mechanism (10, 8) and the spring (11) that supports the weight of the multifunction handle-lever-pedal element.

Figure 8:
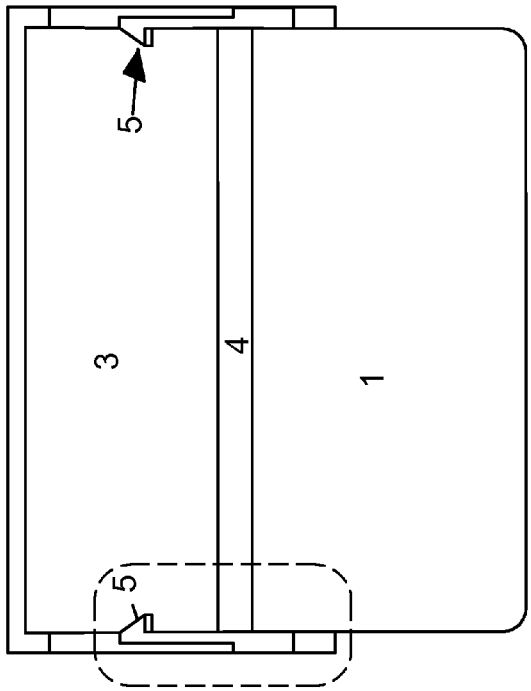
FIG. 8 shows a front view of the container (1) with the multifunction handle-lever-pedal element (2) where a cross-sectional cut B-B' has been made according to that described in FIG. 5, showing the detail of the hooks (5) located in the upper ends of the extensions on the U-shaped parallelogram prism.

In reference to FIG. 8, it shows the back support table for supporting mop (3,4) designed to support the mop, and the multifunction handle-lever-pedal element (2) with the two rectangular parallelograms ending in two hooks (5) oriented inward. It also shows the detail of the hooks.

Figure 10:
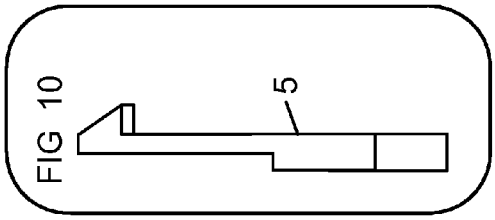
FIG. 10 shows an enlargement of FIG. 8.
Figure 9:
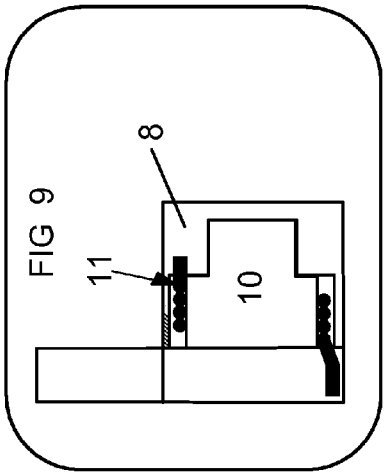
FIG. 9 shows an enlargement of FIG. 7.

In relation to FIGS. 9 and 10, it shows an enlargement of details of FIG. 7 and FIG. 8 respectively. In FIG. 9 it shows an insertion cylinder (10), in FIG. 10 it shows a hook (5).

Figure 11:
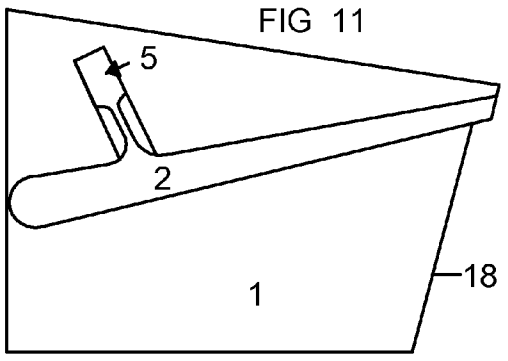
FIG. 11 shows a left side view of the container (1) with the multifunction handle-lever-pedal element (2) where a D-D" cross-longitudinal cut has been made according to that described in FIG. 6, showing a hook (5).

In relation to FIG. 11, it shows the hooks (5) of the multifunction handle-level-pedal element (2), the front end (18), and the bottom end (19) of the liquid drainage container (1).

Figure 12:
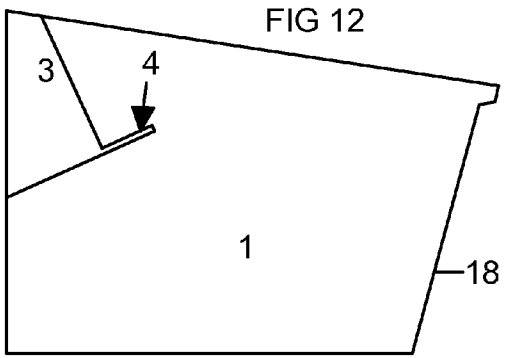
FIG. 12 shows a left side view of the container (1) where an E-E' cross-longitudinal cut has been made according to that described in FIG. 6, showing the back support table for supporting mops (3,4).

In relation to FIG. 12, it shows the back support table for supporting mops (3,4), the front end (18), and the bottom end (19) of the liquid drainage container (1).

Figure 13:
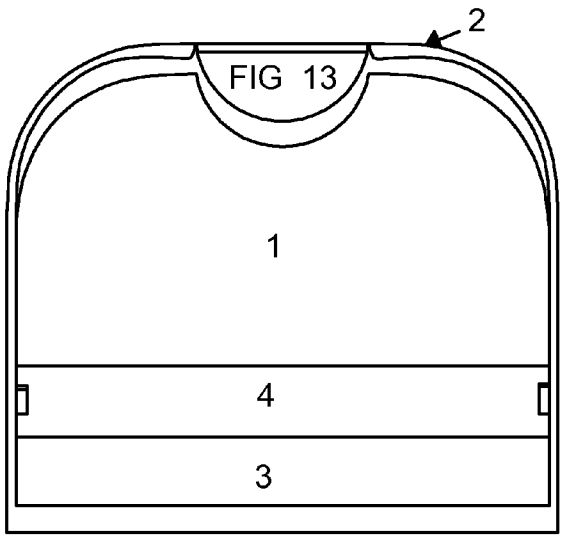
FIG. 13 shows a top view of the container (1) with the multifunction handle-lever-pedal element.

In relation to FIG. 13, it shows a back support table for supporting mops (3,4).

Figure 14:
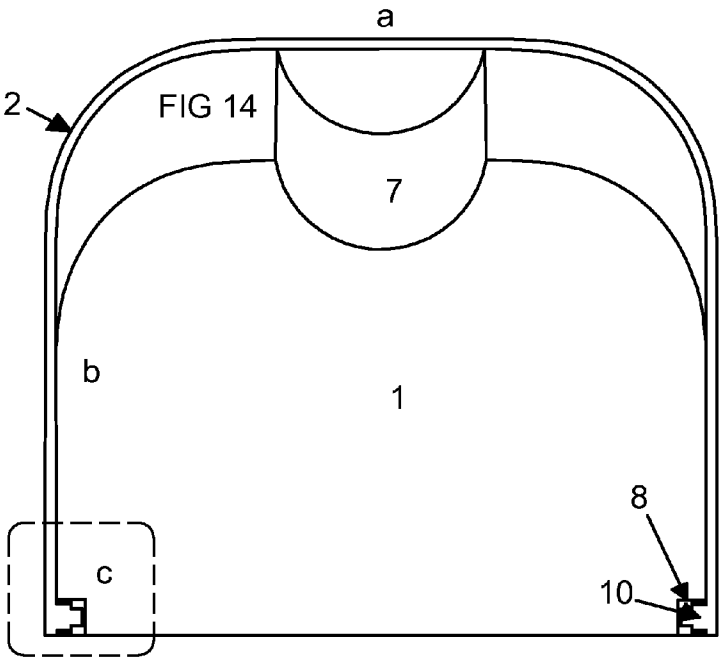
FIG. 14 shows a top view of the container (1) with the multifunction handle-lever-pedal element (2) including a pedal section (a), a lever section (b), and insertion cylinders (c) where a C-C' cut has been made according to that described in FIG. 5, showing in the multifunction handle-lever-pedal element, the section (c) with the details of the coupling mechanism for a base axis {insertion cylinders (10), hollows (8), and springs (11)} in the container.

In relation to FIG. 14, it shows the multifunction handle-lever-pedal element (2) and the depression (7) on the front end of the container. FIG. 14 shows the details of the coupling mechanism (10, 8) for the base axis of the multifunction handle-lever-pedal element (2) in the container (1) and details of the spring (11) that supports the weight of the handle-lever-pedal.

Figure 15:
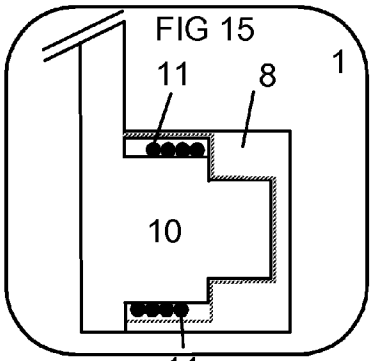
FIG. 15 shows an enlargement of FIG. 14.

In reference to FIG. 15, it shows the coupling mechanism (10,8) and springs (11) coupled in the container (1).

What is claimed is:

1. A mechanical cleaning system mop and container for liquid draining comprising:

a container including a multifunction handle-lever-pedal element, the handle-lever-pedal element including a handle, a lever, and a pedal; the container including a base with an upper end, a bottom end, a front wall, a back wall, side walls, and interior, the base slightly larger in the upper end than the bottom end, a mop;

a back support table for supporting the mop located on the interior of the container, the back support table including a back support placed against the back wall of the container and a table extending from the back support;

a central depression located on the front wall of the container designed to accommodate sliding a foot of a user when the handle-lever-pedal element is activated; and two anti-splash flanges formed on the top end of the front wall of the container on both sides of the depression;

wherein the multifunction handle-lever-pedal element is a one piece device matching the shape of the container in the horizontal direction.

2. The mechanical cleaning system according to claim 1, further including:

a hollow located under the back support table in each one of the side walls of the container;

the handle-lever-pedal element including two arms connected by a curved section, the curved section forms the pedal of the multifunction handle-lever-pedal element, the arms form the lever of the multifunction handle-lever-pedal element;

an extension protruding from each of the arms of the handle-lever-pedal element in the lever section;

a hook protruding from each one of the extensions, the hooks are oriented toward the interior of each of the arms, each hook is inserted into the corresponding hollow; and a cylinder wrapped with a spring, each cylinder is protruding from an end of the arms of the handle-lever-pedal element in a cylinder insertion section.

3. The mechanical cleaning system according to claim 2, wherein each cylinder is inserted into the corresponding hollow of the lateral walls of the container located under the back support table;

the upper ends of the extensions on the handle-lever-pedal having hook-shaped are coupled in the hollows of the lateral walls of the container.

4. The mechanical cleaning system according to claim 1, wherein the mop is drained by pressing the body of the mop over the back support table and pressing the multifunction handle-lever-pedal element.

5. A mechanical cleaning system mop and container for liquid draining comprising:

a container including a multifunction handle-lever-pedal element, the handle-lever-pedal element including a handle, a lever, and a pedal; the container including a base with an upper end, a bottom end, a front wall, a back wall, side walls, and interior, the base slightly larger in the upper end than the bottom end, a mop;

wherein the mop comprises:

a base, the base is made of a rigid material, the base having a shape matching to the shape of a back support table;

a body made of a spongy and highly absorbent material, the body having a shape similar to the shape of the base;

a plate made of flexible material longitudinally intercalated into the spongy body, the plate is perpendicular to the base;

an extension connected to an upper end of the base; and a handle;

wherein the multifunction handle-lever-pedal element is a one piece device matching the shape of the container in the horizontal direction.

6. The mechanical cleaning system according to claim 5, wherein the mop is drained by pressing the body of the mop over the back support table and pressing the multifunction handle-lever-pedal element.

7. A mechanical cleaning system mop and container for liquid draining comprising:

a container including a multifunction handle-lever-pedal element, the handle-lever-pedal element including a handle, a lever, and a pedal; the container including a base with an upper end, a bottom end, a front wall, a back wall, side walls, and interior, the base slightly larger in the upper end than the bottom end, a mop;

a back support table for supporting the mop located on the interior of the container, the back support table including a back support placed against the back wall of the container and a table extending from the back support;

a central depression located on the front wall of the container designed to accommodate sliding a foot of a user when the handle-lever-pedal element is activated;

two anti-splash flanges formed on the top end of the front wall of the container on both sides of the depression;

wherein the mop comprises:

a base, the base is made of a rigid material, the base having a shape matching to the shape of the back support table;

a body made of a spongy and highly absorbent material, the body having a shape similar to the shape of the base;

a plate made of flexible material longitudinally intercalated into the spongy body, the plate is perpendicular to the base;

an extension connected to an upper end of the base; and a handle;

wherein the multifunction handle-lever-pedal element is a one piece device matching the shape of the container in the horizontal direction.

* * * * *